US011320139B2

(12) United States Patent
van Delden et al.

(10) Patent No.: US 11,320,139 B2
(45) Date of Patent: May 3, 2022

(54) LIGHTING MODULE, KIT AND PANEL

(71) Applicant: SIGNIFY HOLDING B.V., Eindhoven (NL)

(72) Inventors: Martinus Hermanus Wilhelmus Maria van Delden, Venlo (NL); Silvia Maria Booij, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/958,720

(22) PCT Filed: Dec. 19, 2018

(86) PCT No.: PCT/EP2018/085811
§ 371 (c)(1),
(2) Date: Jun. 28, 2020

(87) PCT Pub. No.: WO2019/134829
PCT Pub. Date: Jul. 11, 2019

(65) Prior Publication Data

US 2021/0010669 A1 Jan. 14, 2021

(30) Foreign Application Priority Data

Jan. 2, 2018 (EP) ..... 18150008

(51) Int. Cl.
*F21V 33/00* (2006.01)
*F21S 2/00* (2016.01)
(Continued)

(52) U.S. Cl.
CPC ..... *F21V 33/006* (2013.01); *F21S 2/005* (2013.01); *F21V 3/00* (2013.01); *F21V 7/22* (2013.01); *F21V 11/14* (2013.01)

(58) Field of Classification Search
CPC .. F21S 2/005; F21V 11/14; F21V 3/00; F21V 33/006; F21V 7/0033; F21V 7/0041; F21V 7/005; F21V 7/04; F21V 7/05; F21V 7/22
See application file for complete search history.

(56) References Cited

U.S. PATENT DOCUMENTS 3,253,675 A 5/1966 Baruch
3,591,794 A 7/1971 Dail et al.
(Continued)

FOREIGN PATENT DOCUMENTS

DE 19520659 C2 12/1996
DE 102012205188 * 10/2013 ..... F21V 15/01
(Continued)

OTHER PUBLICATIONS

English Machine Translation of DE 102012205188 provided by ESPACENET (Year: 2013).*
(Continued)

*Primary Examiner* — Zheng Song
(74) *Attorney, Agent, or Firm* — Daniel J. Piotrowski

(57) ABSTRACT

A lighting module (10) is disclosed comprising a light mixing chamber (35) delimited by a back plate (40) opposed by a cover plate (20) and a sidewall arrangement (30) extending between the back plate (40) and the cover plate (20); and a light source (45) mounted on the back plate (40) and arranged to emit light into the light mixing chamber (35), wherein the cover plate (20) is transmissive for light emitted by the light source (45) and transmissive for sound waves, and wherein the back plate (40) comprises a plurality of through holes (41), each through hole (41) having a diameter in a range of 50 to 500 micrometers. Also disclosed
(Continued)

are a lighting kit comprising a plurality of such lighting modules (10) and a lighting panel assembled from such a lighting kit.

15 Claims, 6 Drawing Sheets

(51) Int. Cl.
*F21V 3/00* (2015.01)
*F21V 7/22* (2018.01)
*F21V 11/14* (2006.01)

(56) References Cited

U.S. PATENT DOCUMENTS 5,504,281 A * 4/1996 Whitney ..... H04R 1/02 181/286
5,532,440 A * 7/1996 Fujiwara ..... E04C 2/54 181/289
5,942,736 A * 8/1999 Cortonesi ..... E01F 8/0064 181/289
9,904,105 B2 * 2/2018 Ma ..... G02F 1/133606
2007/0165154 A1 * 7/2007 Whitney ..... G02F 1/133605 349/61
2008/0198296 A1 * 8/2008 Chu ..... G02F 1/133603 349/64
2010/0232165 A1 * 9/2010 Sato ..... G09F 13/14 362/296.01
2011/0018012 A1 * 1/2011 Tanaka ..... F21V 13/02 257/89
2011/0131849 A1 * 6/2011 Sato ..... G02B 6/0063 40/564
2011/0317096 A1 * 12/2011 Yokota ..... G02F 1/133606 349/64
2012/0218752 A1 * 8/2012 Sumitani ..... G02F 1/133605 362/235
2012/0268688 A1 * 10/2012 Sato ..... G02F 1/133603 349/62
2013/0010232 A1 * 1/2013 Takahashi ..... F21K 9/232 349/64
2013/0077345 A1 * 3/2013 Sato ..... F21V 11/14 362/609
2013/0094216 A1 * 4/2013 Sato ..... F21V 7/28 362/297
2013/0148357 A1 * 6/2013 Johnston ..... E04B 9/32 362/253
2013/0201690 A1 8/2013 Vissenberg et al.
2014/0160720 A1 * 6/2014 Seuntiens ..... F21V 9/02 362/2
2014/0160765 A1 6/2014 Sato et al.
2014/0226360 A1 8/2014 Krijn et al.
2014/0299408 A1 * 10/2014 Swinkels ..... G10K 11/16 181/289
2015/0309366 A1 * 10/2015 Park ..... G02F 1/133605 349/58
2016/0076737 A1 * 3/2016 Wang ..... G02F 1/133606 362/97.1
2016/0077381 A1 * 3/2016 Ma ..... G02F 1/133606 362/97.1
2016/0186942 A1 6/2016 De Gier
2016/0369972 A1 12/2016 Thijssen et al.
2018/0045396 A1 * 2/2018 Terashima ..... G02F 1/133606

FOREIGN PATENT DOCUMENTS

EP 2573461 A1 3/2013
EP 2813630 A2 12/2014
ES 1043941 U 2/2000
WO 2012156060 A1 11/2012

OTHER PUBLICATIONS

Olga Tourlomousi: "Microperforated Glass—Turning the innovation into a marketable product", Delft University of Technology, Nov. 10, 2017, pp. 1-177, XP055554305.
https://en.wikipedia.org/wiki/Micro_perforated_plate; "Micro performated plate".
http://www.opto-design.com/english/unibrite/, UniBrite.
www.esse-ci.com/immagini/AmbSoft_c_2, "Ambiente Soft".

* cited by examiner

100

LIGHTING MODULE, KIT AND PANEL

CROSS-REFERENCE TO PRIOR APPLICATIONS

This application is the U.S. National Phase application under 35 U.S.C. §371 of International Application No. PCT/EP2018/085811, filed on Dec. 19, 2018, which claims the benefit of European Patent Application No. 18150008.3, filed on Jan. 2, 2018. These applications are hereby incorporated by reference herein.

FIELD OF THE INVENTION

The present invention relates to a lighting module comprising a light mixing chamber delimited by a back plate opposed by a cover plate and a sidewall arrangement extending between the back plate and the cover plate.

The present invention further relates to a lighting kit comprising a plurality of such lighting modules.

The present invention further relates to a lighting panel assembled from such a lighting kit.

BACKGROUND OF THE INVENTION

Advances in lighting technology such as the introduction of solid state lighting (SSL), e.g. as implemented by light emitting diode (LED)-based lighting modules, has transformed the lighting field. For example, lighting panels having very large surface areas, e.g. surface areas of several square meters (m2), such as panels having a surface area in the range of 2-20 m2 by way of non-limiting example, are now available that can transform the lighting experience in enclosed spaces such as large rooms, offices, halls and the like. Such panels in some application domains are provided as at least part of the ceiling of such enclosed spaces, where they provide substantially homogeneous lighting emanating from parts of the ceiling defined by such panels.

One particular challenge associated with such (large area) lighting modules is that in addition to their optical function, they also need to perform an acoustic dampening function in order to preserve the desired acoustics in the enclosed space in which they are fitted. Solutions exist in which such acoustic dampening is provided using glass fibre-based carrier plates that are held in place by a metal frame. This assembly forms the housing of the light engine. Within such a housing, many LEDs may be suspended such that the LEDs face the highly reflective acoustic panels, thereby indirectly illuminating the light exit window of the lighting module, which may be defined by an acoustically transparent member such as a woven or knitted fabric that allows the sound waves to travel through the light exit window such that they can be dampened by the glass fibre panels within the housing. Materials such as plastics and glass are unsuitable as the light exit window material of choice due to their high acoustic reflectivity. However, the optical reflectivity of typical glass fibre panels is limited to 80-85%, which is suboptimal in particular in large area applications. This may be improved using advanced coatings such as sol-gel coatings, but this often is cost-prohibitive.

Another problem is that large area panels are cumbersome to manufacture and handle. An example of such a large area panel luminaire is given by US-2014/160765 A1, which discloses a planar illumination light source apparatus including a point light source having strong directivity; a casing having a bottom surface section with a hole for attaching the point light source, and side surface reflection sections perpendicularly provided from edge sides of the bottom surface section. A light transmitting reflection plate facing the bottom surface section and supported by the side surface reflection sections and a diffusion plate provided so as to be opposed to a surface of the light transmitting reflection plate that is far from the point light source are also present. The light transmitting reflection plate is formed so as to have a higher light transmissivity and lower light reflectivity as being farther away from the point light source. A light emitter is attached to a region irradiated with radiation light from the point light source. However, such a large area panel luminaire exhibits insufficient acoustic performance.

A further example of a light-emitting panel is disclosed in US-2014/226360 A1. This panel has a cellular support panel sandwiched between a first panel sheet and a second panel sheet, wherein the first panel sheet is optically transparent. The cellular support panel has a plurality of tubular channels extending from the first panel sheet towards the second panel sheet, wherein the tubular channels have optically transparent cell walls. The light-emitting panel further has a plurality of light-sources in a two-dimensional light-source array, each light source being arranged to emit light into at least one of the tubular channels of the cellular support panel.

SUMMARY OF THE INVENTION

The present invention seeks to provide a lighting module having a desirable acoustic performance.

The present invention further seeks to provide a kit of such lighting modules.

The present invention further seeks to provide a lighting panel assembled from such lighting modules.

According to an aspect, there is provided a lighting module comprising a light mixing chamber delimited by a back plate opposed by a cover plate and a sidewall arrangement extending between the back plate and the cover plate; and a light source arranged to emit light into the light mixing chamber, wherein the cover plate is transmissive for light emitted by the light source and transmissive for sound waves, and wherein the back plate comprises a plurality of through holes, each through hole having a diameter in a range of 50 to 500 micrometers.

The present invention is based on the insight that the provision of a back plate having a pattern of holes of micrometer dimensions, e.g. a micro-perforated plate, has excellent sound attenuation properties such that any sound waves penetrating the lighting module through the cover plate are effectively absorbed by the lighting module, thereby providing a lighting module that may be used as a surface covering lighting module in order provide both lighting and sound attenuation within a space in which one or more of such lighting modules are fitted.

In the context of the present application, where reference is made to a sidewall arrangement it should be understood that this refers to an arrangement of one or more sidewalls that bind the light mixing chamber in combination with the cover plate and the back plate. The number of sidewalls in the sidewall arrangement will be determined by the cross-sectional shape in the plane of the cover plate and back plate of the lighting module. For example, where the lighting module has a circular cross-section, the sidewall arrangement contains a continuous sidewall circumventing the light mixing chamber, whereas where the lighting module has a polygonal cross-section, the sidewall arrangement contains a plurality of such sidewalls defining the polygonal shape of the lighting module. It should be understood that the lighting module may have any suitable cross-sectional shape such as a circular shape, a triangular shape, a rectangular shape such as a square shape, or other polygonal shapes such as a pentagonal shape, hexagonal shape, trapezoidal shape, rhomboid shape, and so on.

The light source may be mounted on the back plate, but it may also be mounted on the sidewall arrangement, as long as it is arranged to emit light into the light mixing chamber.

In a preferred embodiment, the light source is mounted in a central region of the back plate and the cover plate comprises an opaque central region aligned with the central region of the back plate; and a plurality of apertures increasing in diameter with increasing distance from the opaque central region. Consequently, a lighting module is provided that combines excellent homogeneity in its luminous output due to the provision of a cover plate in which the apertures increase in diameter further away from the opaque centre of the cover plate, whilst the centrally positioned light source, e.g. a point light source such as a solid state lighting element such as for example a COB (Chip-On-Board) LED module, is obscured from direct view by the opaque central region in the cover plate to any observer directly positioned underneath the lighting module.

In a further preferred embodiment, the back plate has a light-reflective surface facing the light mixing chamber, and the combined area of the through holes forms 0.5% to 2% of the total surface area of the light-reflective surface such that the optical performance of the back plate is not substantially compromised by the presence of these through holes. If the combined area is larger than 2%, light losses caused by light passing through the through holes may become unacceptably large, whereas if the combined area is less than 0.5%, the acoustic attenuation properties of the back plate may become insufficient.

At least part of the sidewall arrangement may have a light-reflective surface facing the light mixing chamber. Such a light-reflective surface minimizes light losses within the light mixing chamber and therefore improves the optical efficiency of the lighting module, in particular in scenarios in which the lighting module is used as a standalone module.

Alternatively or additionally, at least part of the sidewall arrangement may be light-transmissive or the sidewall arrangement only partially surrounds the light mixing chamber. This is particularly advantageous where several lighting modules are coupled together, e.g. to form a lighting panel as will be explained in further detail below, such that light can travel between neighboring lighting modules, thereby improving the mixing of light generated by the respective light sources in such a modular lighting panel. This therefore may reduce optical artefacts such as colour over angle artefacts being produced by the lighting modules. Moreover, the acoustical performance of such a modular lighting panel is improved when openings exist in the sidewall arrangement through which the sound waves can travel between lighting modules.

Preferably, the internal surfaces of the cover plate and the back plate, i.e. the surfaces facing the light mixing chamber, are light reflective to minimize light losses within the light mixing chamber. This may be achieved by the inner surfaces carrying a reflective layer, such as a white paint layer, a reflective foil, and so on or by the inner surfaces being made of an intrinsically reflective material, e.g. a metal. Such an intrinsically reflective material may be treated, e.g. polished or the like, to increase the light reflectivity of the material.

In a particular embodiment, the back plate is a metal back plate. As explained above, a metal back plate may be intrinsically light-reflective and has the further advantage that it has good thermal conductivity such that the metal back plate may act as a heatsink for the light source centrally positioned thereon, thereby obviating the need for a separate heatsink structure, which may reduce the cost of the lighting module.

In another particular embodiment, the back plate is a printed circuit board (PCB) comprising a plurality of conductive tracks conductively coupled to the light source. This facilitates ease of manufacture as the light source may be readily coupled to its power supply when using a PCB such as a metal core PCB in which all electrical connections for the light source, e.g. a solid state light source, are already present. In this embodiment, the back plate the typically carries a light reflective layer on its major surface facing the light mixing chamber in order to minimize light losses as previously explained.

The major surface of the cover plate not facing the light mixing chamber, i.e. the external major surface of the cover plate also may be light-reflective. This for example is particularly advantageous where one or more of the lighting modules are covered by a cover of such as a cloth to obscure the lighting modules from direct view, in which case the light-reflective external major surface of the cover plate assists in optical recycling in the space between such a cover and the lighting modules covered thereby.

The lighting module may further comprise a further member covering the back plate such that the back plate is arranged in between the light mixing chamber and the further member. Such a further member, e.g. a further plate, may be used to protect the lighting module from ingress of contamination such as dust particles, moisture, insects, and so on. The further member in at least some of these embodiments may be an acoustically absorbent panel to further assist the acoustic performance of the lighting module, such as a fibre-based panel, e.g. a glass wool panel, a foam panel, or the like.

As previously mentioned, the lighting module may further comprise a cloth spanning the cover plate in order to obscure the lighting module from direct view. Such a cloth typically is acoustically transparent (or at least acoustically transmissive) such that sound waves incident on the cloth can travel through the cloth and reach the lighting module where the sound waves may be absorbed as previously explained.

According to another aspect, there is provided a lighting kit comprising a plurality of lighting modules of any of the herein described embodiments, wherein the lighting modules are configured to be coupled to each other. With such a lighting kit, large area lighting panels may be assembled using a plurality of lighting modules, which significantly simplifies the assembly process of such large area lighting panels. To this end, the lighting modules in such a lighting kit may each have the same dimensions, which is for example typically the case when the large area lighting panel to be assembled has a regular shape such as a rectangular shape, honeycomb shape or the like, although it should be understood that alternatively the lighting kit may comprise lighting modules having different dimensions and/or different cross-sectional shapes in order to facilitate the formation of free-form large area lighting panels.

The lighting kit may further comprise a cloth or fabric for spanning across the lighting modules when coupled together in order to obscure said lighting modules from direct view. This may improve the aesthetic appearance of a large area lighting panels formed from such lighting modules due to the lighting modules not being directly visible.

According to yet another aspect, there is provided a lighting panel formed from the lighting kit of any of the herein described embodiments, wherein at least two lighting modules are coupled together. Such a lighting panel advantageously can be assembled in a straightforward manner by simply coupling lighting modules together. Such coupling together may involve placement of the lighting modules in a purpose-built frame or engaging the lighting modules with each other through a mating mechanism, e.g. a tongue and groove mechanism, a click mechanism, or the like, when assembling the lighting panel.

In an example embodiment, the at least two lighting modules are coupled together in a side-by-side arrangement, optionally wherein the sidewall arrangement in between adjacent lighting modules is optically transmissive and/or comprises openings between adjacent lighting modules. In this embodiment, a large area lighting panel may be formed in a straightforward manner having a regular or free-form shape as previously explained. In this manner, lighting panels having a surface area well in excess of 1 $m^2$, e.g. of up to 10 $m^2$ or beyond may be formed using a plurality of the lighting modules according to embodiments of the present invention, thereby obviating the cumbersome manufacturing of single lighting panels having a surface area of that magnitude.

It should be understood that such a lighting panel is not limited to a large area lighting panel in which the cover plates of the respective lighting modules all face the same way. In an alternative embodiment, the lighting panel comprises a pair of said lighting modules that are coupled together in a back-to-back arrangement, thereby providing a dual-sided lighting panel in terms of luminous output, which for example may be beneficial where the lighting panel is to form part of a vertical partition or the like. A further member such as an acoustic panel may be shared by, i.e. sandwiched in between, the back-to-back arranged lighting modules in order to improve the acoustic performance of such a lighting panel without requiring each lighting module to have its own acoustic panel, thereby reducing the cost of such a lighting panel.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
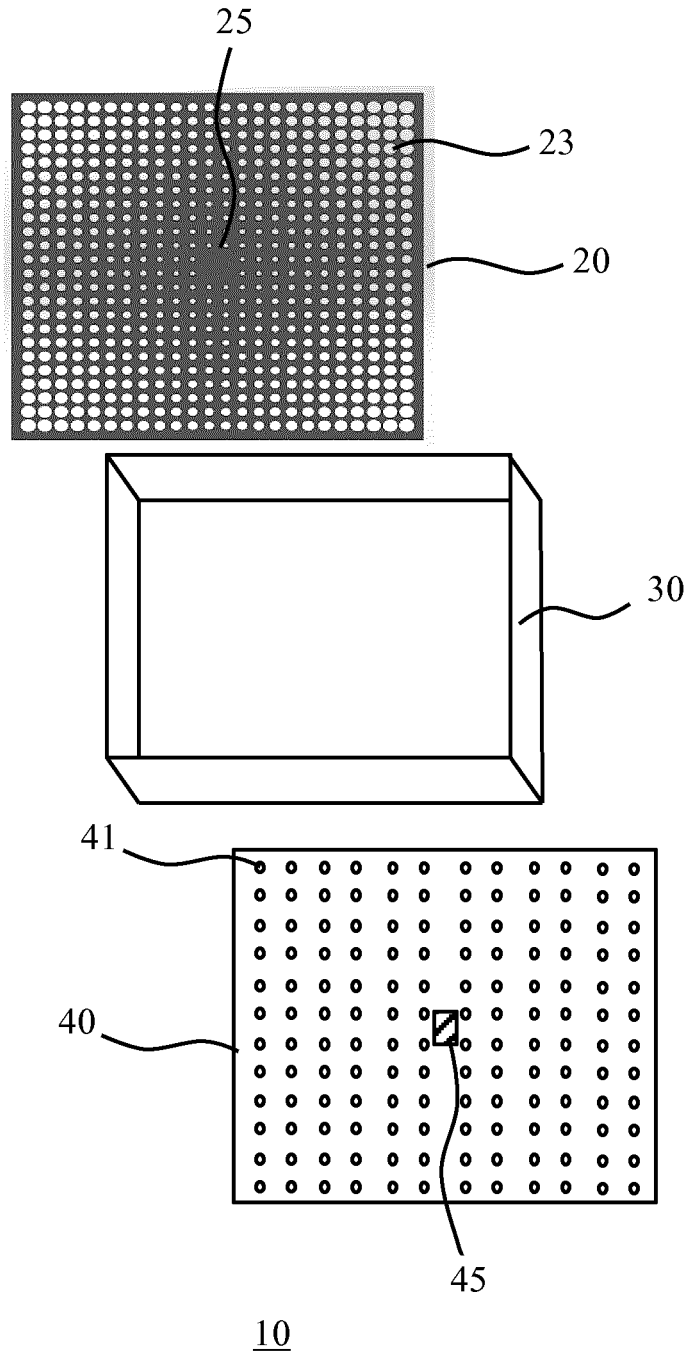
FIG. 1 schematically depicts an exploded view of a lighting module according to an embodiment.

It should be understood that the Figures are merely schematic and are not drawn to scale. It should also be understood that the same reference numerals are used throughout the Figures to indicate the same or similar parts.

Figure 2:
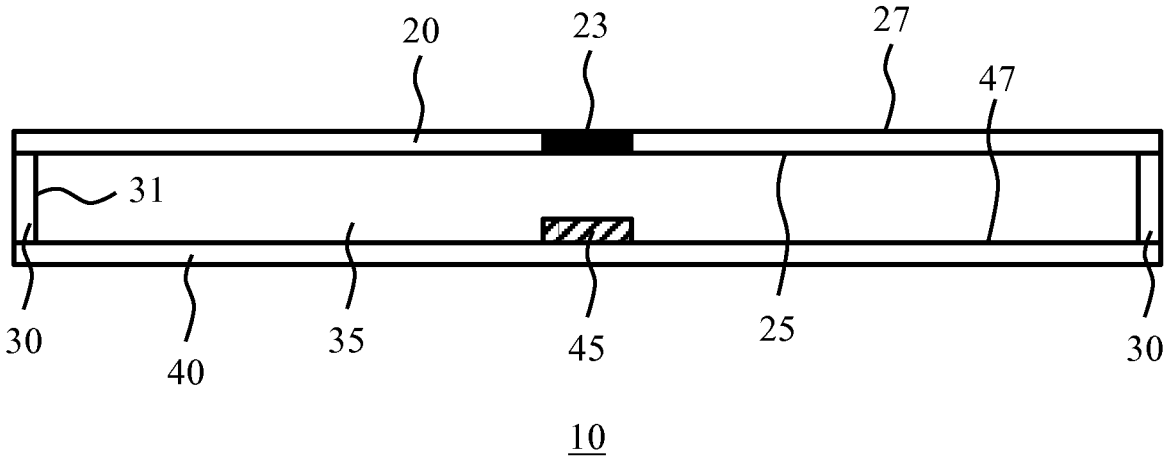
FIG. 2 schematically depicts a cross-sectional view of a lighting module according to an embodiment.

FIG. 1 schematically depicts an exploded perspective view and FIG. 2 schematically depicts a cross-sectional view of a lighting module 10 according to an embodiment of the present invention. The lighting module 10 is shown to have a square outline (cross-sectional shape) by way of non-limiting example only as the lighting module 10 may have any suitable outline, e.g. a circular outline or any other polygonal outline as previously explained. The lighting module 10 comprises a light mixing chamber 35 bound by a cover plate 20 and a back plate 40 opposing the cover plate 20. A sidewall arrangement incorporating one or more sidewalls 30 depending on the outline shape of the lighting module 10 as previously explained extend between the cover plate 20 and the back plate 40, which sidewall arrangement further delimits the light mixing chamber 35.

The cover plate 20 in a preferred embodiment comprises an opaque central region 23, which opaque central region 23 is surrounded by a plurality of apertures 21 that are characterized by having an increasing diameter with increasing distance from the opaque central region 23. In the context of the present application it should be understood that where reference is made to such a diameter, this does not necessarily imply that the apertures 21 are circular apertures. The apertures 21 may have any suitable shape, and in the case of non-circular apertures 21 the term diameter refers to the largest cross-sectional dimension of such non-circular apertures. The provision of an arrangement of apertures 21 that increase in dimension with greater distance from the opaque central region 23 ensures that the luminous output of the lighting module 10 through the cover plate 20 has a high degree of homogeneity. This is because the periphery of the light mixing chamber 35 typically exhibits a low luminous flux than its central region, which phenomenon is compensated by the larger apertures 21 in the peripheral region of the light mixing chamber 35 such that a larger proportion of light can escape from the light mixing chamber through these apertures 21 compared to the small apertures 21 more proximal to the opaque central region 23 of the cover plate 20. However, in other embodiments, a different type of cover plate 20 may be used, e.g. a light-transmissive cover plate 20 that is light-transmissive over its entire surface.

The cover plate 20 may be made of any suitable material such as an optically transmissive material, e.g. an optical grade polymer such as poly (methylmethacrylate) (PMMA), polyethylene terephthalate (PET), polycarbonate (PC) and so on, glass, and other suitable materials. When using optically transmissive materials, at least one of the internal major surface 25 of the cover plate 20 facing the light mixing chamber 35 and the external major surface 27 of the cover plates 20 opposing the internal major surface 25 carries an opaque layer (not shown) through which the apertures 21 extend. The opaque layer may be a reflective layer, e.g. a layer of white paint, a reflective foil, a reflective coating, etcetera, which when present on the internal major surface 25 of the cover plate 20 may assist in the light recycling within the light mixing chamber 35.

Alternatively, the cover plate 20 may be made of an opaque material, e.g. a metal plate, in which case the opaque layer may be omitted. Preferably, at least the internal major surface 25 of the cover plate 20 is light-reflective to assist in the light recycling within the light mixing chamber 35 as previously mentioned. As before, a reflective layer may be used on the internal major surface 25 for this purpose or alternatively, the internal major surface 25 may be intrinsically light-reflective, e.g. may be a (polished) metal surface such as an aluminium surface.

The cover plate 20 in a preferred embodiment has an open structure such that light can escape from the light mixing chamber 35 of the lighting module 10 whilst sound waves can enter the lighting module 10 through the apertures 21 of the cover plate 20. For example, about 20-40% of the total surface area of the cover plate 20 may be formed by the apertures 21 in order to provide the desired openness of the cover plate 20, with the apertures 21 typically having a diameter in the millimeter range.

In a preferred embodiment, the back plate 40 has a central region aligned with the opaque central region 23 of the cover plate 20 in which a light source 45 is mounted. Preferably, the light source 45 is a point light source such as a solid state lighting element, e.g. an LED or the like. In a particular embodiment, the light source 45 is a COB LED. Such LEDs can produce a large luminous flux and therefore can give the lighting module 20 a bright appearance. The alignment between the central region of the back plate 40 in which the light source 45 is mounted and the opaque central region 23 of the cover plate 20 ensures that the light source 45 is obscured from direct view by an observer standing directly below the lighting module 20, thereby protecting such an observer from glare. Even if such an observer looks at the lighting module 20 under an angle, the occurrence of glare is effectively suppressed by the fact that the apertures 21 proximal to the opaque central region 23 have a small diameter thereby also effectively shielding the light source 45 from direct view. However, in alternative embodiments multiple light sources 45 are distributed across the major surface 47 of the back plate 40 facing the light mixing chamber 35.

The back plate 40 comprises a plurality of through holes 41 having a diameter in the micrometer range, e.g. a diameter in a range of 50-500 micrometer (micron). The density of the through holes 41 is such that they form about 0.5-2% of the total surface area of the back plate 40 in order to minimize light losses from the light mixing chamber 35 through these through holes 41. For example, the back plate 40 may be a micro-perforated plate comprising a regular pattern of such through holes 41 although it should be understood that the through holes 41 are not necessarily arranged in a regular pattern and at any suitable distribution of through holes 41 across the back plate 40 may be contemplated. The through holes 41 may be formed through the back plate 40 in any suitable manner, e.g. perforation, (laser) drilling, and so on.

It surprisingly has been found that when the back plate 40 comprises such through holes 41 having a diameter in the micro-meter range can effectively absorb sound waves that enter the lighting module 10 through the cover plate 20. Without wishing to be bound by theory, it is believed that due to the typical wavelength of sound waves, the sound waves undergo destructive interference or friction in the through holes 41, which causes the sound energy to be dissipated as heat by the back plate 40, whereas the optical performance of the back plate 40 is not substantially compromised due to the fact that the through holes 41 only cover a small fraction of the total surface area of the back plate 40. Consequently, the lighting module 10 according to embodiments of the present invention has the ability to effectively dampen sound waves incident on the light module 10 without significantly compromising its optical performance.

For example, where a lighting module having a back plate with 2 mm sized through holes behind which a top of the range acoustic panel with 85% light reflectivity is placed exhibits an optical efficiency of 74%, the lighting module of the present invention achieves an optical efficiency of 80% even in the absence of such an acoustic panel, using reflective inner surfaces of the light mixing chamber having a light-reflective efficiency in the range of 95-98%.

The back plate 40 may be made of any suitable material. For example, the back plate 40 may be made of a metal or another heat conductive material, which assists in the dissipation of the sound energy and the heat generated by the light source 45. The internal major surface 47 of the back plate 40 facing the light mixing chamber 35 may carry a light-reflective layer, e.g. a white paint layer, a reflective foil, a reflective coating, and so on to reduce the light losses from the light mixing chamber 35 as previously explained in case the internal major surface 47 is not intrinsically light-reflective. As will be understood from the foregoing, such a light-reflective layer may be omitted where the back plate 40 is highly reflective itself, e.g. in case of a (polished) metal back plate 40. In another embodiment, the back plate 40 comprises a PCB such as an MCPCB, which has the advantage that the conductive tracks for connecting the light source 45 to a power supply are already present in the back plate 40, thereby aiding the ease of manufacturing of such a lighting module 10. However it should be understood that any suitable implementation of the back plate 40 may be contemplated, including embodiments in which the back plate 40 is formed as a stack of layers performing different functions, e.g. a layer stack including a reflective layer facing the light mixing chamber 35, a heatsink layer, an electrical connection layer, an acoustic dampening layer, and so on. Other embodiments of such a back plate 40 will be readily available to the skilled person.

The sidewall arrangement comprising one or more sidewalls 30 equally may be made of any suitable material. At least some of the sidewall arrangement, i.e. at least some of the sidewalls 30 may have an inner surface 31 facing the light mixing chamber 35 that is light-reflective. To this end, such sidewalls 30 may carry a light-reflective layer such as a layer of white paint, a reflective foil, a reflective coating, and so on or alternatively such sidewalls 30 may be made of an intrinsically reflective material such as a (polished) metal.

Where the lighting module 10 is to be used as a standalone lighting device, typically all the sidewalls 30 of the sidewall arrangement have a light-reflective inner surface 31 such that light is effectively recycled within the light mixing chamber 35 to optimize its optical performance in terms of luminous efficiency. However, as will be explained in further detail below, the lighting module 10 may form part of a larger area lighting panel in which several lighting modules 10 are combined to form the lighting panel. In such a lighting panel, adjacent sidewalls 30 of neighboring lighting modules 10 may be optically transmissive, e.g. optically transparent, such that light can travel between neighboring lighting modules 10, thereby improving the light mixing of the light generated by the light sources 45 in such a light panel due to the fact that the light is mixed in a larger light mixing chamber 35. This for instance may assist in suppressing optical artefacts such as colour over angle artefacts in which different spatial components of the luminous output of such a light source 45 may have a different spectral composition, as is well-known per se. In such embodiments, the optically transmissive sidewalls 30 of the sidewall arrangement may be made of any suitable optically transmissive material, such as for example PC, PMMA, PET, glass, or the like. It is pointed out for the avoidance of doubt that in such an embodiment of the lighting module 10 may comprise a surface arrangement comprising both light-reflective surfaces and light-transmissive surfaces as will be explained in further detail below.

Alternatively, part of the sidewall arrangement may be omitted, i.e. only partially surrounds the light mixing chamber 35 such that the light mixing chamber 35 has openings in the sidewall arrangement through which light and sound can travel between adjacent lighting modules 10. In some embodiments, up to 50% of the sidewall arrangement may be omitted, with the remaining sidewalls having a light reflective inner surface 31 to recycle light within the light mixing chamber 35. This has the advantage that less light losses are experienced compared to having light transmissive side walls 30, whilst a broader acoustic spectrum can be absorbed by the modular lighting panel formed of such lighting modules 10.

Figure 3:
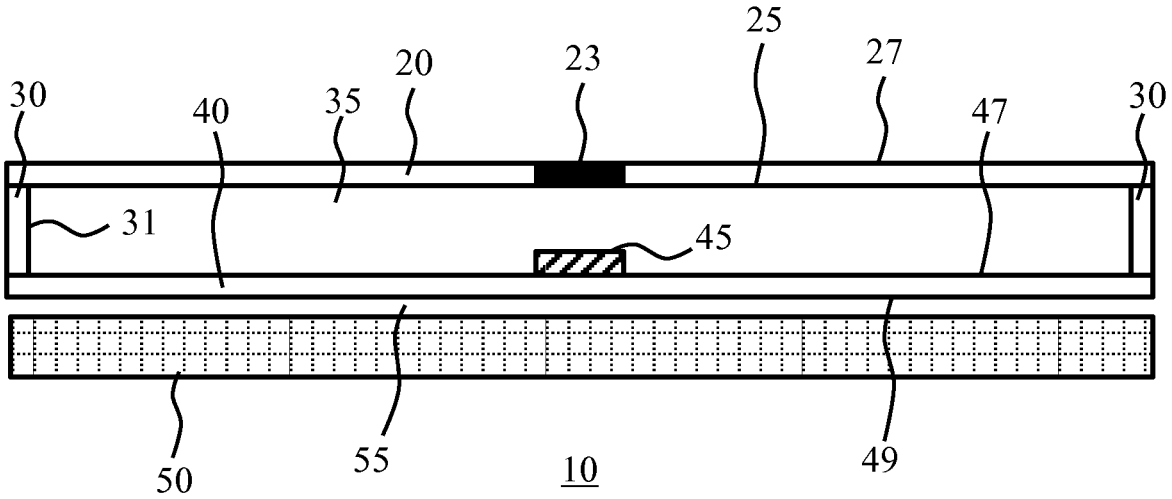
FIG. 3 schematically depicts a cross-sectional view of a lighting module according to another embodiment.

FIG. 3 schematically depicts a cross-sectional view of another embodiment of the lighting module 10 in which the lighting module 10 further comprises a further member 50 covering the external major surface 49 of the back plate 40. Such a further member 50 for example may be used to protect the lighting module 10 from ingress of contaminants such as dust particles, insects, moisture, and so on through the through holes 41 extending through the back plate 40. Any suitable material may be used for such a further member 50. The further member 50 may be provided as a plate that covers the external major surface 49 of the back plate 40. In a particularly advantageous embodiment, the further member 50 is provided as an acoustic plate, i.e. a plate made of an acoustically absorbent material, such as a fibrous material such as glass wool, a foam, or the like. This has the advantage that the acoustic performance of the lighting module 10 is further improved by sound waves travelling through the back plate 40 being absorbed by such an acoustic plate. In other to optimize the performance of such an acoustic plate, the acoustic plate 50 may be spatially separated by an air gap 55 from the back plate 40, e.g. an air gap 55 in the range of 2-5 cm.

A lighting kit may be provided comprising a plurality of such lighting modules 10, in which the lighting modules 10 may be combined (assembled) to form a lighting panel. Such a lighting kit may comprise identical lighting modules 10 such as for example tile-shaped lighting modules having dimensions of 30×30 cm, 60×60 cm, 30×60 cm by way of non-limiting example as the lighting modules 10 may have any suitable dimensions, which may be used to form a regularly shaped (tiled) lighting panel in which the lighting modules 10 are arranged in a side-by-side arrangement. Alternatively, such a lighting kit may be used to form a free-form lighting panel. This may be achieved with a lighting kit comprising identically shaped and sized lighting modules 10 or alternatively may be achieved with a lighting kit comprising differently shaped and/or sized lighting modules 10. For the avoidance of doubt, it is of course equally feasible to assemble a lighting panel having a regular shape using differently shaped and/or sized lighting modules 10.

Figure 4:
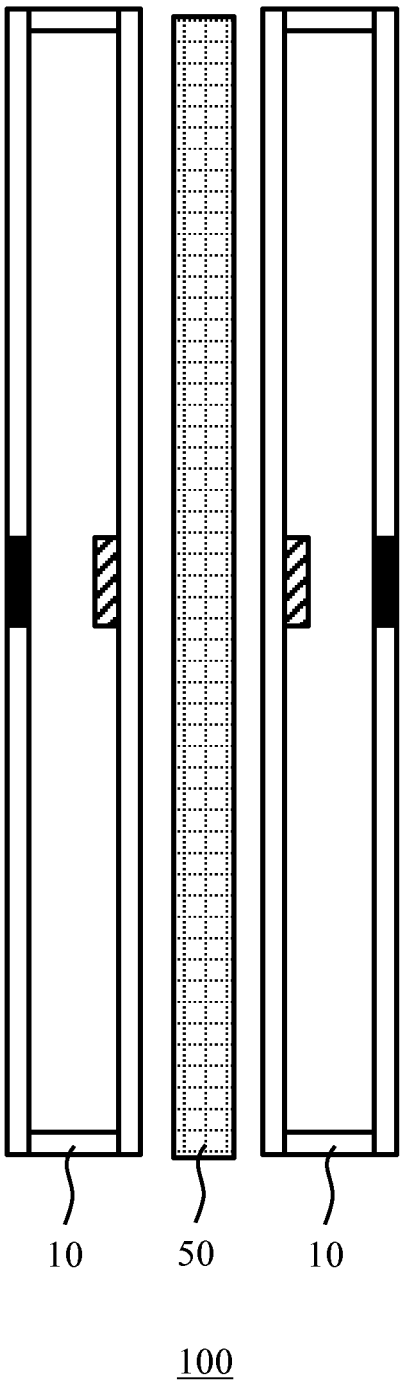
FIG. 4 schematically depicts a cross-sectional view of a light panel according to an embodiment.

An example embodiment of such a modular lighting panel 100 is schematically depicted in FIG. 4, in which two lighting modules 10 are arranged in a back-to-back orientation with the respective back plates 40 of the lighting modules 10 facing each other. Such a lighting panel 100 therefore is capable of producing a luminous output through opposing light exit surfaces, i.e. the respective cover plates 20 of the back-to-back arranged lighting modules 10, which for example may be useful where the lighting panel 100 is to form a partition between two spaces. As will be readily understood by the skilled person, such a lighting panel 100 may easily be extended by adding further back-to-back oriented lighting modules 10, which may be arranged in a sideways arrangement with other of such back-to-back oriented lighting module pairs, thereby constructing a large area panel 100 that for example may serve as an illuminated partition wall.

In such a lighting panel 100 comprising back-to-back oriented lighting modules 10, a further member 50 such as an acoustic plate may be sandwiched between the back-to-back oriented lighting modules 10 to further improve the acoustic performance of the lighting panel 100. It should be understood that in this embodiment a single further member 50 may be shared by both lighting modules 10 although alternatively each lighting module 10 may comprise its own further member 50.

Figure 5:
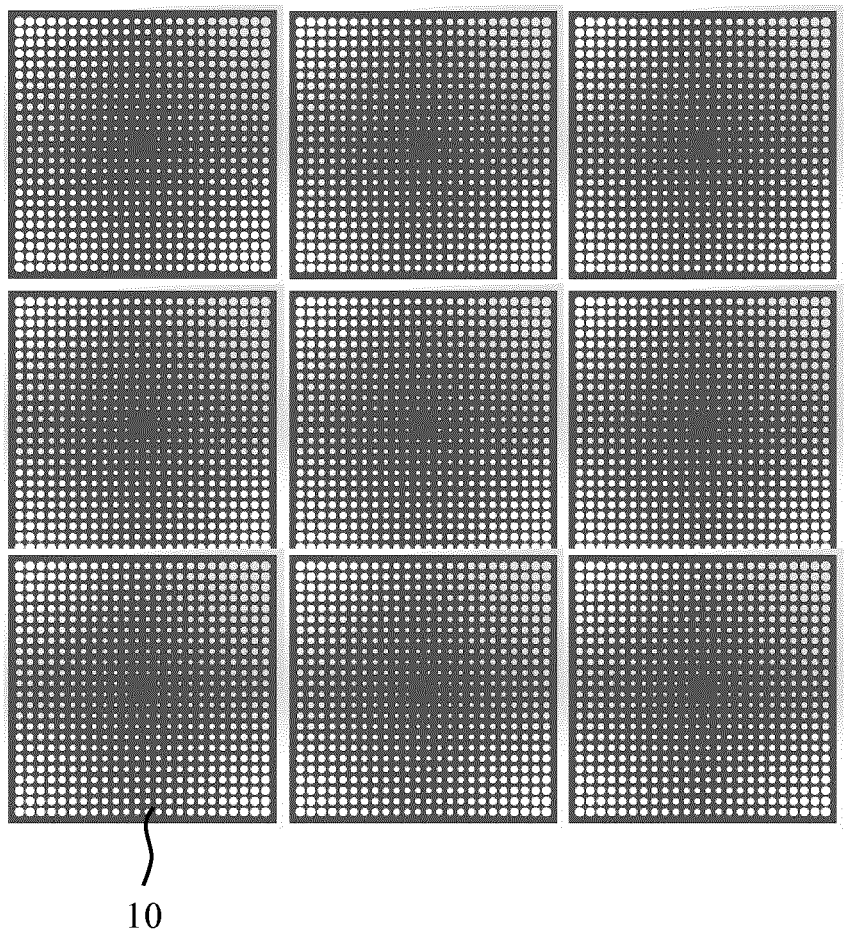
FIG. 5 schematically depicts a top view of a light panel according to another embodiment.
Figure 6:
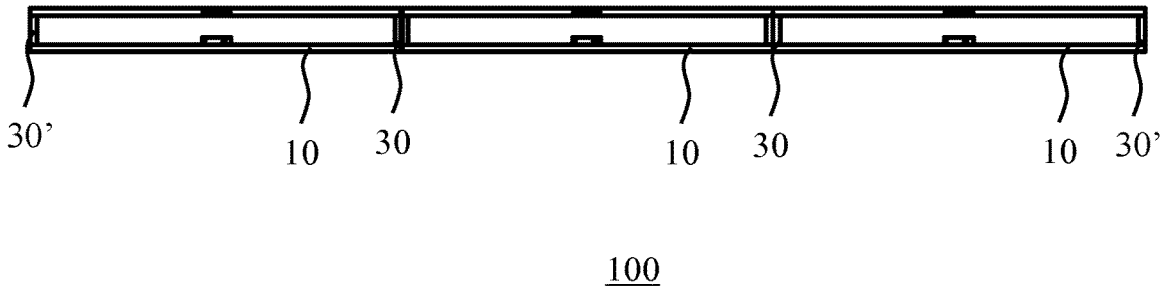
FIG. 6 schematically depicts a cross-sectional view of a light panel according to another embodiment.

Another example embodiment of such a modular lighting panel 100 is schematically depicted in FIG. 5, in which a plurality lighting modules 10 are arranged in a side-by-side orientation in which all the cover plates 20 of the lighting modules 10 face the same way, with some of the sidewalls 30 facing each other. A cross-sectional view of such a lighting panel 100 is schematically depicted in FIG. 6, where it can be seen that the sidewalls of the lighting modules 10 within the lighting panel 100 can be divided into internal sidewalls 30 and external sidewalls 30', with each internal sidewall 30 facing another internal sidewalls 30 and the external sidewalls 30' defining the perimeter of the lighting panel 100.

In an embodiment, the internal sidewalls 30 are optically transmissive such that the light generated by the light sources 45 in the respective lighting modules 10 can travel across the full area of the lighting panel 100. In other words, the individual light mixing chambers 35 of the respective lighting modules 10 are combined into a single lighting panel-wide light mixing chamber, thereby improving the degree of mixing of the light emitted by the respective light sources 45 and suppressing optical artefacts in the luminous output of the lighting panel 100 as a result. In contrast, the external sidewalls 30' of the lighting panel 100 are light-reflective such that light cannot escape the panel-wide light mixing chamber through these sidewalls, thereby optimizing the optical efficiency of the modular lighting panel 100. As previously mentioned, such optical and acoustic coupling between adjacent lighting modules 10 additionally or alternatively may be achieved by the sidewall arrangement comprising openings between adjacent lighting modules 10 through which the light and sound waves can travel. Alternatively, both the internal sidewalls 30 and the external sidewalls 30' may be light-reflective such that each light mixing chamber 35 of the lighting modules 10 making up the modular lighting panel 100 is optically bound by its internal sidewalls.

The lighting modules 10 may comprise any suitable mating mechanism such as for example a tongue and groove mechanism, a click mechanism, and so on, to facilitate assembly of the lighting modules 10 into a modular lighting panel 100. In this manner, a large area lighting panel 100, e.g. a lighting panel having a surface area in excess of 1 $m^2$ or even 10 $m^2$, can be formed in a straightforward manner by combination of the lighting modules 10 in any suitable arrangement, e.g. a regular arrangement or free-form arrangement as previously explained.

Figure 7:
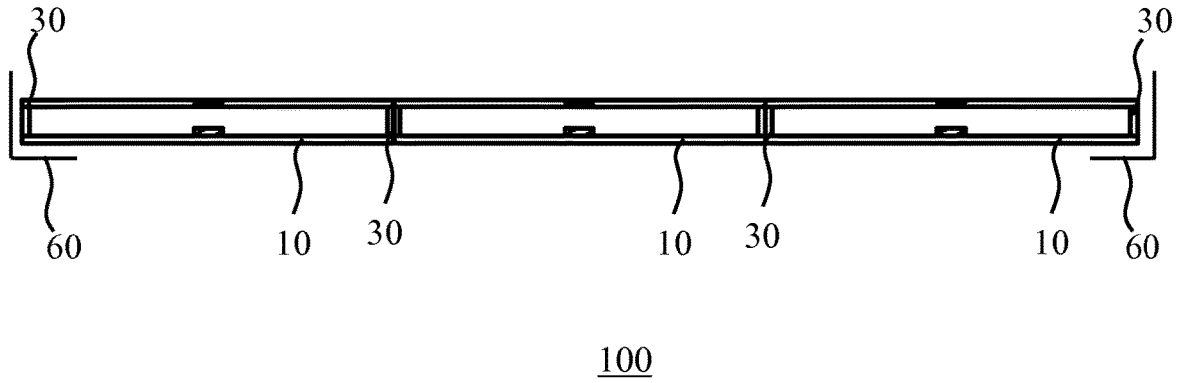
FIG. 7 schematically depicts a cross-sectional view of a light panel according to still another embodiment.

Alternatively, as schematically depicted in FIG. 7, the modular lighting panel 100 may be formed by mounting the individual lighting modules 10 in a frame 60 in which case the lighting modules 10 may not require such a mating mechanism. What is more, where the frame 60 is made of a light-reflective material, e.g. a metal frame 60, both the internal sidewalls 30 and the external sidewalls 30' may be optically transmissive, which has the advantage that identical lighting modules 10 may be used for the assembly of the modular lighting panel 100, as the panel-wide light mixing chamber is bound by the light-reflective surfaces of the frame 60 facing the external sidewalls 30' of the individual lighting modules 10.

Figure 8:
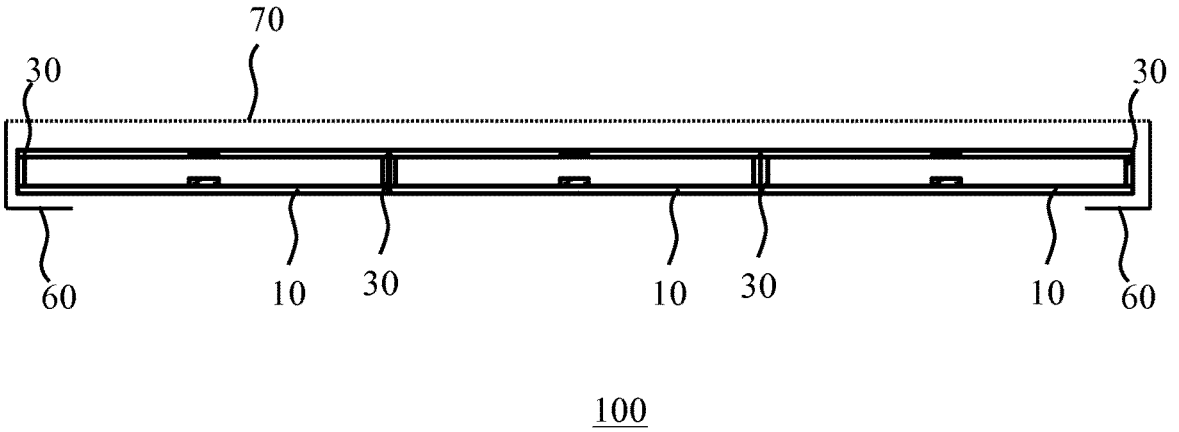
FIG. 8 schematically depicts a cross-sectional view of a light panel according to yet another embodiment.

In an embodiment, the lighting kit from which such a modular lighting panel 100 may be formed may further comprise a cloth or fabric 70 that can be spanned across the cover plates 20 of the individual lighting modules 10 when the modular lighting panel 100 is assembled as is schematically depicted in FIG. 8. Such a cloth or fabric 70 helps to obscure the respective cover plates 20 of the individual lighting modules 10 from direct view and may exist in further homogenizing the luminous output of the modular lighting panel 100. The cloth or fabric 70 may be made of any suitable material that is both acoustically and optically transmissive such that sound waves can travel through the cloth or fabric 70 and reach the lighting modules 10 whilst light emitted by the lighting modules 10 through the respective cover plates 20 can exit the modular lighting panel 100 through the cloth or fabric 70. Where such a cloth or fabric 70 is to be used over one or more lighting modules 10, the external major surface 27 of the cover plate 20 of such one or more lighting modules 10 preferably is made highly light-reflective in order to assist the recycling of light captured in between the one or more lighting modules 10 and the cloth or fabric 70. To this end, the external major surface 27 of the cover plate 20 may be intrinsically light-reflective, i.e. made of a light-reflective material such as a metal, or alternatively may carry a light-reflective layer such as a white paint layer, a reflective foil, a reflective coating, and so on.

Figure 9:
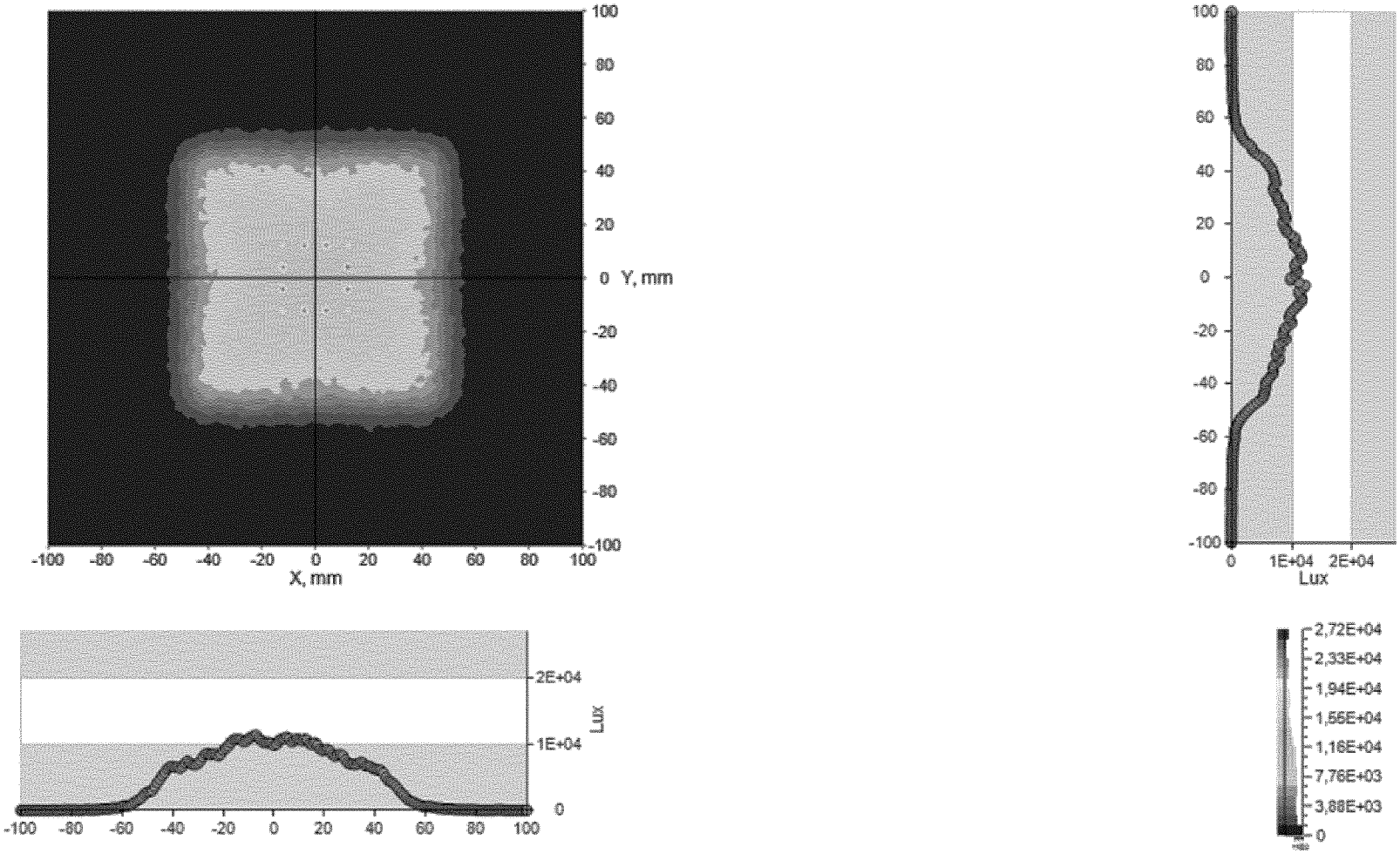
FIG. 9 depicts the results of a simulation of the optical performance of a lighting module according to an example embodiment.

FIG. 9 depicts the simulation result of an optical simulation of the uniformity of the luminous output emitted through the cover panel 20 of a 100×100 mm lighting module 10 comprising a COB LED as its central light source 45 at a distance of 10 mm from the cover plate 20. As can be seen from the simulation results, a high degree of uniformity in the luminous output in terms of luminous intensity is achieved even without the use of the cloth 70, thereby demonstrating that the lighting modules according to embodiments of the present invention are capable of producing a highly homogeneous luminous output, such that when such lighting modules are combined into a lighting panel 100, a large area lighting panel may be provided capable of producing a highly homogeneous luminous output across its surface area.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting module comprising:

a light mixing chamber, and a light source arranged to emit light into the light mixing chamber, wherein the light mixing chamber is delimited by a back plate opposed by a cover plate and a sidewall arrangement extending between the back plate and the cover plate, wherein the cover plate is transmissive for light emitted by the light source and transmissive for sound waves, wherein the back plate has a light-reflective surface facing the light mixing chamber, wherein the light source is mounted to the light-reflective surface of the back plate, wherein the back plate comprises a plurality of through holes, each through hole having a diameter in a range of 50 to 500 micrometers, and wherein the combined area of the through holes forms 0.5% to 2% of the total surface area of the light-reflective surface, and wherein the lighting module further comprises a further member covering the back plate such that the back plate is arranged in between the light mixing chamber and the further member.

2. A lighting kit comprising a plurality of lighting modules of claim 1, wherein the lighting modules are configured to be coupled to each other.

3. A lighting panel formed from the lighting kit of claim 2, wherein at least two lighting modules are coupled together.

4. The lighting panel of claim 3, wherein the at least two lighting modules are coupled together in a side-by-side arrangement, optionally wherein the sidewall arrangement in between adjacent lighting modules is optically transmissive and/or comprises openings between adjacent lighting modules.

5. The lighting panel of claim 3, wherein a pair of said lighting modules are coupled together in a back-to-back arrangement.

6. The lighting module of claim 1, further comprising a cloth or fabric spanning the cover plate.

7. The lighting kit of claim 6, further comprising a cloth for spanning across lighting modules when coupled together in order to obscure said lighting modules from direct view.

8. The lighting module of claim 1, wherein said further member is an acoustic plate.

9. The lighting module of claim 8, wherein the acoustic plate is spatially separated from the back plate by an air gap, said air gap in the range of 2-5 cm.

10. The lighting module of claim 1, wherein the light source is mounted in a central region of the back plate and wherein the cover plate comprises:

an opaque central region aligned with the central region of the back plate; and a plurality of apertures, each of which increasing in diameter with increasing distance in a radial direction from the opaque central region.

11. The lighting module of claim 1, wherein at least part of the sidewall arrangement has a light-reflective surface facing the light mixing chamber.

12. The lighting module of claim 1, wherein at least part of the sidewall arrangement is light-transmissive or wherein the sidewall arrangement only partially surrounds the light mixing chamber.

13. The lighting module of claim 1, wherein the back plate is one of a metal back plate and a printed circuit board comprising a plurality of conductive tracks conductively coupled to the light source.

14. The lighting module of claim 1, wherein a major surface of the cover plate not facing the light mixing chamber is light-reflective.

15. The lighting module of claim 1, wherein the back plate does not extend beyond an outermost part of the mixing chamber sidewall arrangement in a horizontal direction.

* * * * *